US006092268A

United States Patent [19]

Mack

[11] Patent Number: 6,092,268

[45] Date of Patent: Jul. 25, 2000

[54] APPARATUS FOR AUTOMATIC REMOVAL OF ROVING RESIDUES FROM ROVING BOBBIN TUBES

[75] Inventor: Karl Heinz Mack, Weilheim, Germany

[73] Assignee: Zinser Textilmaschinen GmbH, Ebersbach/Fils, Germany

[21] Appl. No.: 09/437,459

[22] Filed: Nov. 10, 1999

[30] Foreign Application Priority Data

Nov. 10, 1998 [DE] Germany ..... 198 51 751

[51] Int. Cl.[7] ..... B65H 73/00

[52] U.S. Cl. ..... 28/292; 28/296

[58] Field of Search ..... 28/292, 293, 294, 28/295, 296, 289, 297, 298; 57/281, 90, 300, 303, 304, 305, 306; 139/232 R, 232 B, 232 C, 261, 273 A

[56] References Cited

U.S. PATENT DOCUMENTS

| | | | |
|---|---|---|---|
| 4,078,282 | 3/1978 | van Daalen | 28/295 |
| 4,765,043 | 8/1988 | Yamashita | 28/294 |
| 4,783,887 | 11/1988 | Trias | 28/292 |
| 4,970,764 | 11/1990 | Trias | 28/292 |
| 5,179,769 | 1/1993 | Ferguson, Sr. et al. | 28/292 |
| 5,207,051 | 5/1993 | Inger et al. | 57/281 |
| 5,220,714 | 6/1993 | Sanno | 28/294 |

FOREIGN PATENT DOCUMENTS

| | | |
|---|---|---|
| 0 727 380 | 8/1996 | European Pat. Off. . |
| 195 05 225 | 8/1996 | Germany . |

*Primary Examiner*—Amy B. Vanatta
*Attorney, Agent, or Firm*—Herbert Dubno

[57] ABSTRACT

Roving residue is removed from roving-bobbin tubes returned from the ring-spinning machines to the roving frame and upon detection of residual roving, that tube which carries a residue is switched with a tube from a magazine containing residue-free tubes. A color sensor detects the color of the tube with the residue to be removed from the train and a tube of corresponding color is positioned at the changeover station of the magazine. The colors and positions of the tubes in the magazine can be stored in data storage or a color sensor can detect the color of the tube in the magazine at the changeover position.

4 Claims, 3 Drawing Sheets

APPARATUS FOR AUTOMATIC REMOVAL OF ROVING RESIDUES FROM ROVING BOBBIN TUBES

FIELD OF THE INVENTION

My present invention relates to an apparatus for the automatic removal of roving residues from roving-bobbin tubes and, more particularly, for providing a succession of residue-free tubes which can be fed to a roving frame so that, for example, sliver can be wound as roving in bobbins on these tubes and the full roving bobbins can be fed to a spinning machine, e.g. a ring-spinning machine in which the roving is converted to a spun yarn and from which the roving bobbin tubes, usually with a roving residue, are returned to the roving frame.

BACKGROUND OF THE INVENTION

In an apparatus for the automatic removal of roving residues from roving-bobbin tubes, a sensor can detect a roving residue on tubes returned from the spinning frames and an automatic device can be triggered for removing those residues at least to a significant extent. In many cases, however, the automatic removal of the roving residue itself is incomplete and at least some of the roving-bobbin tubes will retain traces of rovings, i.e. residual roving.

So that a succession of empty roving-bobbin tubes can be returned to the roving frame or frames completely free from traces of the rovings, the traces are detected and roving-bobbin tubes which are empty, i.e. completely free from a roving residue, can be drawn from a magazine containing a store of such tubes and substituted for those tubes which have been incompletely stripped of the roving residues. For this purpose, the sensor downstream of the stripping device cooperates with a control unit which actuates a change mechanism and withdraws the empty tube from the magazine and substitutes it for the tube which still carries at least traces of the rovings.

It is known to color code such tubes as well so that rovings of different types are wound on tubes of a respective color and, as a consequence, it is important that color correspondence be maintained, i.e. that the tubes which are fed in each succession be of corresponding color.

In a standard yarn-producing operation, the full roving bobbins are supplied to a spinning machine or frame, e.g. a ring-spinning frame and when the roving runs out or there is a roving breakage, replacement of a roving-bobbin tube usually carrying turns of residual roving by a full roving bobbin can be automatically effected. This doffing operation results in a succession of roving-bobbin tubes having various amounts of residual roving thereon. This is the case because the bobbin-change operation is usually carried out before the roving is fully unwound from the bobbin, thereby ensuring that the spinning stations will not operate without a continuous supply of the roving. The residual roving on such tubes can range from several turns of the roving to several layers of such turns. Before such "empty" tubes are mounted on the spindles of the roving frame, these roving residues must be removed.

For this purpose, apparatus has been provided heretofore in a variety of forms. Reference may be had to the international patent classification Class B65H 73/00 covering such devices. Such devices for the removal of roving residue are referred to also as cleaning devices. They can remove the residue by suction, by flushing them off, by brushing them off or by stripping them from the tube in some other manner as long as the removal takes place without damage to the roving-bobbin tube.

Sensors for the detection of roving residue can also be of a wide variety of types. They can be optoelectronic and can cooperate with reflective foil on the sleeves; they can be of a video-type utilizing an image detected by the sensor. The sensor should have a range which covers the portion of the tube most likely to carry the residue and hence the capture strip which is provided on such a tube to engage or grip the roving. Such a capture strip may be composed of burrs or projections adapted to grip the roving as a leading end of the roving approaches the roving tube in the winding of the roving on the empty tube.

Depending upon the construction of the cleaning unit and its efficiency of operation, traces of the roving residue can remain on the roving-bobbin tubes. In other words, up to now it has not been possible to remove all of the residue completely or so perfectly that every tube following the cleaning operation can be said to be completely freed from the roving. A residual portion of roving can remain either because the cleaning operation is insufficient or because the time available for cleaning is insufficient.

DE 195 05 225 A1 and the corresponding EP 0 727 380 B1 describes the replacement of roving-bobbin tubes which have been insufficiently cleaned and thus which carry traces of the residue of the roving, by tubes which are free from roving traces.

Along the path between the ring-spinning machine and the roving frame of the empty roving-bobbin tubes, along which such a cleaning system can be provided, it is also known to substitute tubes of one color for another since different color tubes are intended to carry rovings of different types. As a consequence, it is important to ensure that in the replacement of a tube having a trace of roving thereon by a roving-free tube, that the replacement is made by a tube of the same color so that the yarn quality is maintained and there is no interruption in either the bobbin-forming operation or the spinning operation resulting from a switch in the color of the tubes carrying the bobbins.

OBJECTS OF THE INVENTION

It is, therefore, the principal object of the present invention to provide an apparatus which will ensure a color-correct replacement of the bobbins in the case in which a bobbin carrying a trace of the roving is replaced by a roving-free bobbin.

Another object of the invention is to provide an improved apparatus for removing roving residues from roving-bobbin tubes whereby drawbacks of earlier systems are avoided and the succession of empty roving-bobbin tubes supplied to the roving frame are all of the desired color code.

SUMMARY OF THE INVENTION

These objects and others which will become apparent hereinafter are attained, in accordance with the invention by providing a sensor responsive to the color of a roving-bobbin tube having a roving residue following the cleaning operation and which is to be replaced by an empty tube from the magazine and means for determining the color of the residue-free tube so that the replacement of the tube carrying the roving residue by the roving-free tube is effected in a color-correct manner.

More particularly, an apparatus for removing roving residues from roving-bobbin tubes having respective colors functionally differentiating the tubes can comprise:

means forming a path along which a succession of the tubes with roving residues are displaceable;

residue-removal means along the path for stripping roving residue from the tubes;

a residue sensor for detecting-residual roving on roving-bobbin tubes following residue removal by the residue-removal means;

an empty-tube magazine containing roving-free tubes of different colors;

a tube-change mechanism responsive to the residue sensor for substituting in the succession of tubes a roving-free tube for a roving-bobbin tube having residual roving thereon;

a color sensor for detecting a color of a roving-bobbin tube having residual roving thereon to be replaced by a roving-free tube at the tube-change mechanism; and control means responsive to the color sensor and adapted to determine a color of a roving-free tube in a change position of the magazine for feeding from the magazine to the tube-change mechanism a roving-free tube of corresponding color to that detected.

According to one aspect of the invention, the control means for determining a color of a roving-free tube in a change position of the magazine, comprises a data storage storing data as to the color and positions of roving-free tubes in the magazine.

In accordance with another aspect of the invention, control means for determining a color of a roving-free tube in a change position of the magazine, comprises a further color sensor for detecting the color of a roving-free tube in a change position of the magazine.

When the position and color of a tube in the magazine is determined by the use of a data storage or memory, then the control means is provided automatically with information as to the color of the tube disposed at the change position of the empty-tube magazine.

Of course, the detection of the actual color of the tube in the change position can eliminate possible errors with respect to the charging of the magazine with the tubes. The color sensor responsive to the tube in the change position of the magazine can control the movement of the empty tube magazine so that the tube of the correct color is properly positioned for the change. This latter approach permits charging of the magazine with the empty tubes in an optional manner without concern as to tube color and position. When the control device no longer can avoid or position a tube of a corresponding color at the change position, an error signal can be generated which is detected by service personnel.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
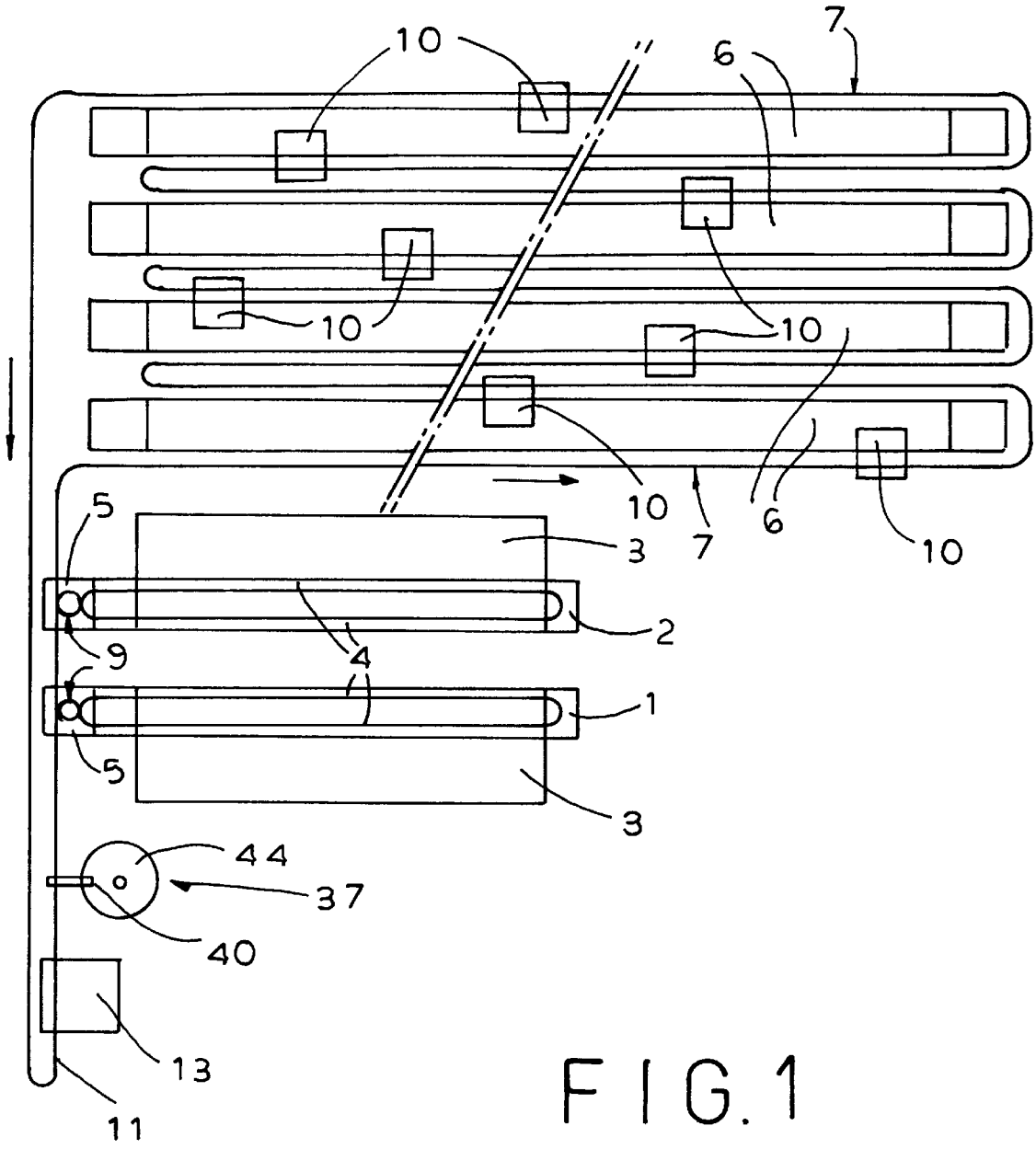
FIG. 1 is a plan view of a spinning plant having a cleaning device in accordance with the invention.

As can be seen from FIG. 1, a spinning plant according to the invention can comprise two roving frames 1,2 whose sliver can fields 3 are juxtaposed with the spinning frame and feed sliver to the respective spindles of the roving frame. A suspension track 4 services the roving frames and a suspension train 19, from which full bobbins or empty tubes can be suspended, is displaceable on the tracks 4. The suspension train 19 has been represented structurally in FIGS. 2 and 3 and comprises support rollers riding on the track and friction rollers which drive the train (see DE 42 29 296 A1).

The roving frames 1, 2 are designed to wind roving onto empty roving-bobbin tubes to form respective bobbins which are then replaced by empty tubes. The empty tubes can be drawn from the suspension train 19 and replaced on the train by full bobbins.

From the suspension tracks 4 the full bobbins removed from the roving frames 1,2 are transferred by transfer units 5 onto similar trains 19 on a suspension track 7. The trains 19 on this track may be individual trains or part of a single continuous train looping along the ring-spinning machines 6. The full bobbins can be transferred to the creels of these ring-spinning machines and empty bobbins, usually with residual roving, can be transferred to the creels and replaced by full bobbins on the ring-spinning machines when a bobbin change or bobbin replacement operation is effected.

The transfer units 5 are of conventional design and need not be described in greater detail. They can be similar to the transfer unit 37 and can operate by engaging the bobbin/tubes from below, lowering them, rotating the lowered bobbin/tubes, and raising the bobbin/tube once again into the grippers on the suspension carriages of the suspension train and/or a magazine as will be described in greater detail below. The transfer units 37 have arms 39 and the region swept by these arms have diagrammatically been represented by the circles 9 in FIG. 1.

At the ring-spinning machines 9, the full bobbins can be removed by hand from the suspension track 7 and placed in the respective creels while empty roving-bobbin tubes with roving residues thereon can be removed from the creels and mounted on the suspension track 7 to return in succession to the roving frames 1, 2. Alternatively, an automatic doffer 10 can be used for removing the empty tubes from the respective spinning stations of the ring-spinning machines and replacing them by full bobbins.

As a consequence, the rail 7 serves to deliver the succession of sleeves or tubes from which respective bobbins have been unwound and which are empty except for roving residues to the roving frames 1,2. The suspension train 19 can be made up of a chain of carriages or trolleys, each of which has a hanger engageable in an upper end of a tube which may be empty or may carry a full bobbin.

To remove the roving residues from these tubes, along the path defined by the track 7, a cleaning device 13 is provided which removes roving resides and is located in a region 11 between the ring-spinning machines 6 and the roving frames 1, 2.

Figure 2:
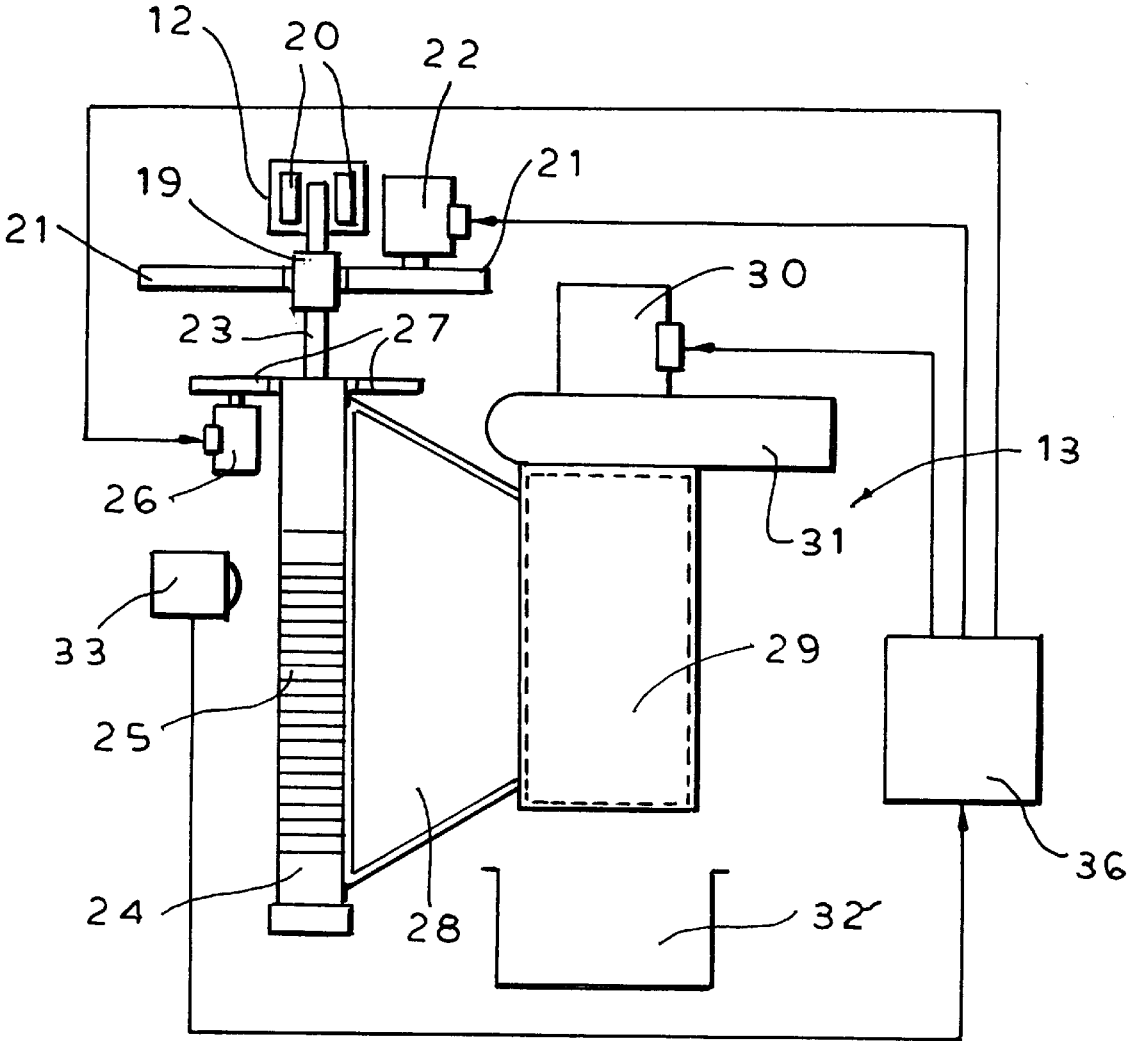
FIG. 2 is a side view of the cleaning device.

In FIG. 2, this cleaning station has been shown in greater detail, the segment of track 12 in this station forms part of the rail system 7 and has the suspension train 19 located therein and supported on the track segment 12 by the roller pair 20. The train is advanced by the friction wheel path 21 driven by an electric motor 22. The train 19 has hangers 23 from which the empty sleeves or tubes 24 are suspended, these tubes having roving residues 25. The sleeves 24, in the cleaning position can be rotated by another pair of friction rollers 27 driven by an electric motor 26 about the respective tube axes.

At the cleaning station extending over the full height of the tube 24 and under suction is a nozzle 28 which draws the roving residue from the tube 24 as the latter is rotated about this axis. The nozzle 28 is connected with a suction source represented by the suction blower 31 driven by an electric motor 30. A sieve drum 29 on which the residue can collect is provided between the blower 31 and the nozzle 28 and below this sieve drum, a collecting bin 32 can be provided to receive the roving pieces removed from the respective tube. The motor 30 is controlled to permit lower high suction to be supplied and, depending upon the requirement, more than one suction nozzle can be used to strip the removing residue from each tube or from a plurality of tubes simultaneously.

It has been found to be especially advantageous to provide two suction nozzles opposite one another to simultaneously strip roving from a tube or to provide two such nozzles side by side to simultaneously strip roving from two tubes which are deposed one behind the other along the succession of tubes defined along the track 7. The rotary drive for the drum 29 has not been illustrated.

An optoelectronic sensor 33 is provided to detect roving residue 25 on the tube 24 passing this sensor. The sensor 33 can be trained on the catcher strip 34 of the tube and can be so designed that it responds to a color or brightness difference between a roving-residue-free strip or a strip covered with a roving residue. The sensor 33 can, if desired, also be trained upon a portion of the tube provided with a reflection foil 35 and can be so designed that it responds to the difference between a foil covered with a roving residue and such foil when the roving residue is absent.

The sensor 33 is connected with a controller 36 which controls the motor 22 of the friction wheel path 21, the motor 26 of the roller path 27 and the motor 30 of the blower 31.

Figure 3:
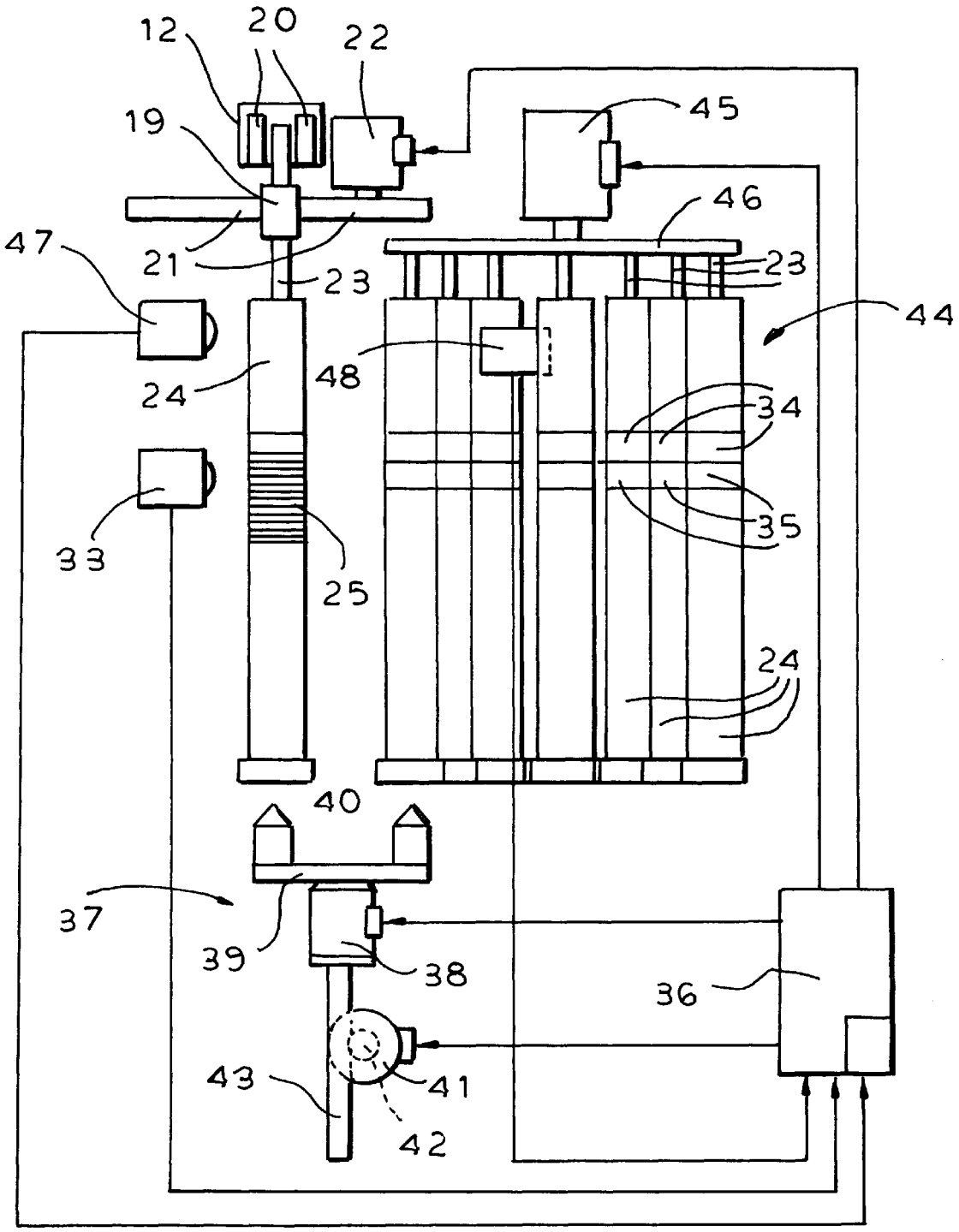
FIG. 3 is a side view of the empty sleeve replacement unit.

FIG. 3 shows the system at the replacement station downstream of the cleaning unit 13. The tube switching mechanism is represented generally at 37. This station can be the same as that at which the suction device is provided although it is prepared to provide it so that it is offset from the cleaning station, especially since only one switching station is usually necessary although there may be a multiplicity of cleaning stations or cleaning nozzles at the cleaning station.

The mechanism 37 comprises a double-arm member 39 which can be swung about a vertical axis at the center of these arms through 180° and in which the arms carry at their ends respective tube grippers 40 in the form of bobbins engageable from below in the tubes.

As the member 39 is raised to engage a tube in the magazine 40 and the tube on the train 19, the respective tubes are released by their hangers and can be lowered so that, upon rotation of the arms 39, the tube formerly on the train 19 can be placed in the magazine and the tube from the magazine is substituted for it on the train at the next rise of member 39. The arms 39 can be raised and lowered via a rack 43 and a pinion 42 engaging the rack and driven by a further electric motor 41 operated by the controller 36.

Thus the swingable arm transfer device 37/39 can switch empty tubes 24 from the magazine 44 onto the track 7 and replace tubes with roving residues on them by tubes free from such residues. The magazine 44 can be in the form of a dip 46 driven by another electric motor 45 operated by the controller 36 and formed with hangers 23 carrying the roving-residue-free tubes 24.

The transfer unit 37 responds to a sensor for the residue 25 on the tubes which can be identical to the sensor 33 previously described for the cleaning unit. This sensor is also connected to the controller 36 which has been described and which operates the motors 38, 41 and 45, or can be another controller.

As the train 19 travels past the sensor 33 at the transfer unit 37, this sensor detects any traces of the residue 25 remaining on the tubes 24 and when such a residue is detected, the controller 36 brings the train to standstill via the friction wheel pair 21 and its motor 22 or so slows the latter so that the tube or a number of tubes will be juxtaposed with the suction nozzle 28 or a plurality of nozzles.

Simultaneously, the controller 36 turns on the motor 26 of the roller pair 27 to rotate the tube 24 juxtaposed with the nozzle, and the motor 30 of the blower 31 to suck the roving residue onto the drum 26 from which the residue deposits in the collector 32. If there are a number of suction stations, these steps are effected in parallel at all of the suction stations.

The cleaning unit 13 can operate for a certain time period which will be sufficient to remove all residues which may normally be present on the tubes. However, it is possible to monitor the residue removal and shut down the suction only when no more roving residue is removed by the nozzle. In that case, the sensor can be an optoelectronic sensor disposed in the suction nozzle.

When a sensor 33 detects a remaining residue on a tube as it is advanced to the switching station 37, the controller 36 raises, lowers, rotates and raises again the pivotal arms 39 to switch the residue-carrying tube of the train 19 for a residue-free tube from the magazine. Upon a rotation through 180°, the tubes are switched in position and upon raising and lowering via the motor 31, the switched tubes are mounted on the hangers 23 of the train 19 and the magazine.

The tube carrying the residue can be removed by hand from the magazine, cleaned and returned to the magazine.

According to the invention, along the path of the tubes 24 through the cleaning device 13 and/or downstream thereof, a color sensor 47 can be arranged which detects the color of a passing tube. This color sensor can be located anywhere upstream of the switching position. It is located at a level such that it can ascertain the color of the color coding of the tube in a region which is not covered even by a complete innermost winding layer of residual roving.

At the switching position, a further color sensor 48 can be arranged which detects the color of the tube 24 to be switched with the residue-carrying tube. When, therefore, the cleaning device does not completely remove the roving residue from a tube, that tube is switched with a tube of the same color from the magazine which can rotate until the sensor 48 matches the color of the tube at the switching position with that detected by the sensor 47. At this point the magazine is brought to standstill for the switch in the manner described.

Alternatively, a data store or memory 36' can be provided in the controller 37 and can memorize the position and color of the residue-free tubes in the magazine so that the controller can advance the tube of the selected color to the changeover positions.

I claim:

1. An apparatus for removing roving residues from roving-bobbin tubes having respective colors functionally differentiating said tubes, said apparatus comprising:

means forming a path along which a succession of said tubes with roving residues are displaceable;

residue-removal means along said path for stripping roving residue from said tubes;

a residue sensor for detecting residual roving on roving-bobbin tubes following residue removal by said residue-removal means;

an empty-tube magazine containing roving-free tubes of different colors;

a tube-change mechanism responsive to said residue sensor for substituting in said succession of tubes a roving-free tube for a roving-bobbin tube having residual roving thereon;

a color sensor for detecting a color of a roving-bobbin tube having residual roving thereon to be replaced by a roving-free tube at said tube-change mechanism; and control means responsive to said color sensor and adapted to determine a color of a roving-free tube in a change position of said magazine for feeding from said magazine to said tube-change mechanism a roving-free tube of corresponding color to that detected.

2. The apparatus defined in claim 1 wherein the control means, for determining a color of a roving-free tube in a change position of said magazine, comprises a data storage storing data as to the color and positions of roving-free tubes in said magazine.

3. The apparatus defined in claim 1 wherein the control means, for determining a color of a roving-free tube in a change position of said magazine, comprises a further color sensor for detecting the color of a roving-free tube in a change position of said magazine.

4. The apparatus defined in claim 1 wherein said path extends between at least one roving frame and at least one ring-spinning frame.

* * * * *